US006557232B2

(12) United States Patent
Fildan et al.

(10) Patent No.: US 6,557,232 B2
(45) Date of Patent: May 6, 2003

(54) METHOD OF MAKING BRASSIERE FASTENER BY INJECTION MOLDING ON FABRIC TAPE

(75) Inventors: Gerhard Fildan, Vienna (AT); Karl Wanzenböck, Leobersdorf (AT)

(73) Assignee: Fildan Accessories Corporation, Englewood, NJ (US)

( * ) Notice: Subject to any disclaimer, the term of this patent is extended or adjusted under 35 U.S.C. 154(b) by 0 days.

(21) Appl. No.: 09/995,233

(22) Filed: Nov. 27, 2001

(65) Prior Publication Data

US 2002/0033559 A1 Mar. 21, 2002

Related U.S. Application Data

(62) Division of application No. 09/562,179, filed on May 2, 2000, now Pat. No. 6,321,419.

(51) Int. Cl.[7] ..... B23P 17/00; A44B 1/42

(52) U.S. Cl. ..... 29/411; 24/114.6

(58) Field of Search ..... 29/411, 412, 413, 29/417, 419; 24/664, 673, 114.6, 662, 693, 701, 669, 695, 702; 2/338; 156/73.3; 264/1.36

(56) References Cited

U.S. PATENT DOCUMENTS

| | | | | |
|---|---|---|---|---|
| 736,811 A | * | 8/1903 | Booth | |
| 4,606,079 A | * | 8/1986 | DeWoskin | 2/338 |
| 6,353,978 B1 | * | 3/2002 | Kawahara et al. | 24/114.4 |

* cited by examiner

*Primary Examiner*—John C. Hong
(74) *Attorney, Agent, or Firm*—Herbert Dubno

(57) ABSTRACT

A method of making snap type hook-and-eye fasteners for garments such as brassieres in which the fabric halves are injection molded on respective tapes, the tapes are covered with brushed fabric which is welded to the tapes along longitudinal welds having gaps in them. The tapes are cut across at the gaps leaving pockets into which parts of the garment can be introduced to secure the tapes on the garments.

2 Claims, 11 Drawing Sheets

FIG. 10
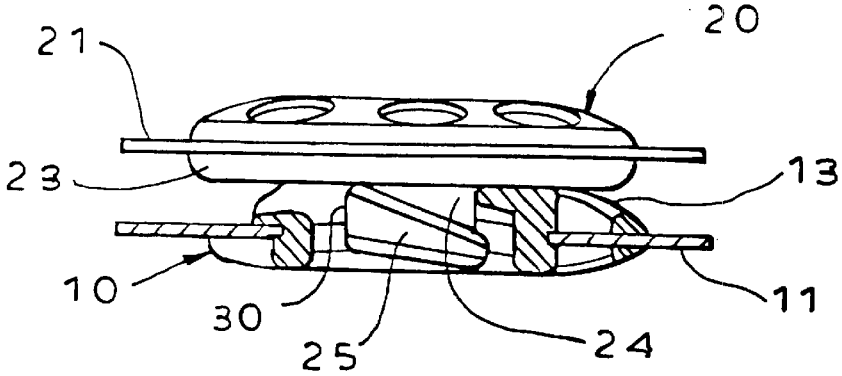
FIG. 11
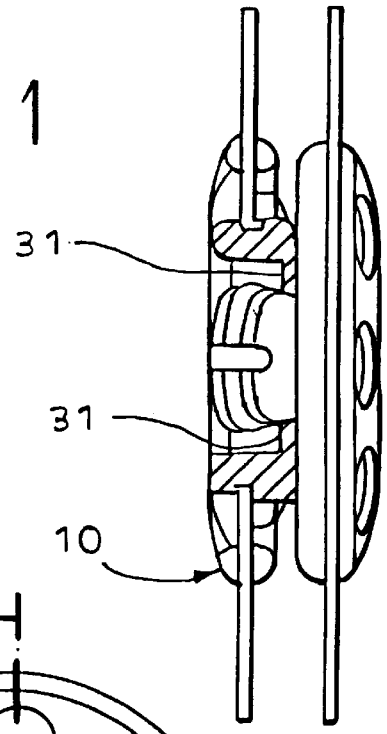
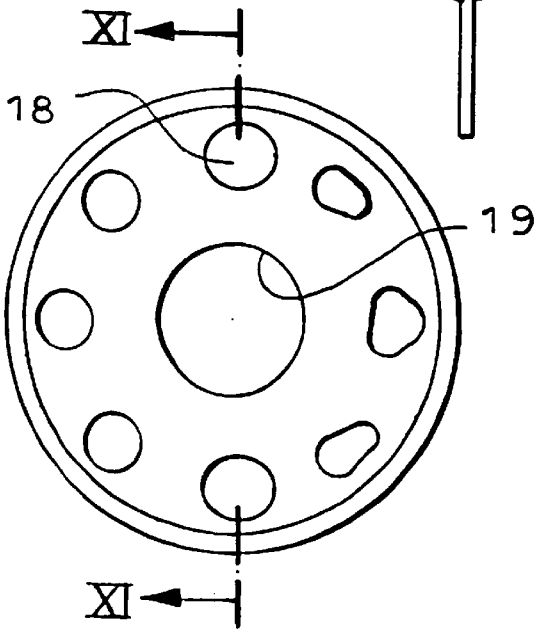
FIG. 9

METHOD OF MAKING BRASSIERE FASTENER BY INJECTION MOLDING ON FABRIC TAPE

CROSS REFERENCE TO RELATED APPLICATION

This application is a division of application Ser. No. 09/562,179 filed May 2, 2000 now U.S. Pat. No. 6,321,419.

FIELD OF THE INVENTION

Our present invention relates to brassiere fasteners, particularly for the back strap of a brassiere and, in general, to so-called hook-and-eye fasteners generally used to interconnect two garment parts, especially, the parts of the back strap of a brassiere, or to snap-type and pushbutton closures which can be used between garment parts.

The invention, in particular, relates to strap fasteners of the type described in application Ser. No. 09/443,082 filed Nov. 18, 1999 (U.S. Pat. No. 6,309,489 issued Oct. 30, 2001).

BACKGROUND OF THE INVENTION

In the past, the back strap of a brassiere has been connected via hook-and-eye fasteners in which, on one strap part, at least one and usually a multiplicity of hooks are provided for engagement into eyes correspondingly provided on another part of the strap. For wide straps the hooks and eyes can be provided two or three abreast and, to allow adjustability, one of the fastener members, either the hooks or eyes, may be spaced apart along the length of one of the strap portions. Where two or three fastener elements are provided across the width of the strap portion, rows of the elements may be spaced apart in the length of that fastener element.

While hook-and-eye fasteners of this type are convenient for fastening behind the back of the wearer, the nature of the hook caused the hook to press into the back of the wearer when, for example, the wearer might lean back against a supporting surface.

While press-button or snap-type fasteners are also known to couple fabric parts together, a press button being provided on one part with, for example, a mushroom-shaped compressible pin or projection and a receiving member on the other garment formed with a hole which may be undercut to allow the head of the projection to engage beneath a rim or other formation, such fasteners are difficult to secure behind one's back because of the problem of aligning the pin with the hole and thus have not been successful as brassiere fasteners or the like. Furthermore, the kind of adjustability and ease of connection afforded by hook-and-eye fasteners is not characteristic of press button or snap-type fasteners.

The aforementioned copending application, which is incorporated herein in its entirety by reference, inter alia, provides a fastener system which has characteristics of a press button or snap-type fastener and utilizes disk-shaped male and female halves which are connected by pin-and-eye formations and which, when joined, provide a particularly thin closure which can be separated by pulling apart the male and female fastener halves transversely to the tapes upon which they are provided.

Although this kind of closure represents a major advantage, particularly for back straps of brassieres, it is capable of further improvement.

OBJECTS OF THE INVENTION

It is, therefore, the principal object of the present invention to provide an improved garment closure which further develops the principles set forth in U.S. Pat. No. 6,309,489 and at the same time accomplishes the objects there set forth in a particularly convenient and effective manner.

It is another object of this invention to provide and improved garment fastener which is highly compact and comfortable for the garment wearer and is characterized by ease of manufacture, ease of connection and separation and particular suitability for delicate garments which might otherwise be damaged by washing or cleaning processes.

Still another object of the invention is to provide an improved brassiere fastener without many of the drawbacks of earlier hook-and-eye fasteners.

It is also an object of the invention to provide an improved method of making a garment fastener and especially a fastener for the back strap of the brassiere.

SUMMARY OF THE INVENTION

These objects and others which will become apparent hereinafter are attained, in accordance with the invention, in a garment fastener which comprises:

- a male fastener half injection-moldable onto a first tape and adapted to be secured to one part of a garment, the male fastener half being formed with a generally flat circular body having an outer body portion on one side of the first tape and an inner body portion on another side of the first tape, a pin projecting generally centrally from the inner body portion, and a head formed on the pin; and
- a female fastener half injection-moldable onto a second tape and adapted to be secured to another part of the garment, the female fastener half being formed with a generally flat circular body having an outer body portion on one side of the second tape and an inner body portion on another side of the second tape, the inner body portion having an eyelet dimensioned to receive and retain the head and an inlet slot leading to the eyelet through which the pin is laterally insertable, the head being withdrawable from the eyelet in a direction perpendicular to the tapes.

According to the invention, the slot has an inwardly convergent mouth and the head, which can be split for flexibility, is tapered from a narrow portion to a thick position in a direction of insertion of the pin into the eyelet through the slot. The inner portion of the female fastener half can have inclined flanks engaging the head and guiding the head into the eyelet.

As in our earlier fastener it is highly advantageous to provide the inner body portion of one of the fastener halves as a convex element and the inner body portion of the other fastener half as a concave element which receives the convex inner body portion of the first fastener half in a nested relationship.

According to another aspect of the invention, each of the tapes may have a plurality of the respective fastener halves spaced apart thereon in a row transverse to the aforementioned insertion direction and for adjustability of the back strap, at least the tape provided with the female fastener members may have a plurality of such rows longitudinally spaced thereon.

The tapes may each be covered at least on one side with a brushed fabric strip ultrasonically welded to the tape along the edges and the garment part can be stitched or otherwise fastened between the respective tape and the brushed fabric strips.

The tapes can be woven of a synthetic resin yarn and the fastener halves can be composed of polyoxymethylene (POM) or polyamide (PA). A brassiere according to the invention can have a back strap, portions of which are interconnected by at least one garment fastener comprising:

a male fastener half injection-moldable onto a first tape and adapted to be secured to one portions of the back strap, the male fastener half being formed with a generally flat circular body having an outer body portion on one side of the first tape and an inner body portion on another side of the first tape, a pin projecting generally centrally from the inner body portion, and a head formed on the pin;

a female fastener half injection-moldable onto a second tape and adapted to be secured to another of the portions of the back strap, the female fastener half being formed with a generally flat circular body having an outer body portion on one side of the second tape and an inner body portion on another side of the second tape, the inner body portion having an eyelet dimensioned to receive and retain the head and an inlet slot leading to the eyelet through which the pin is laterally insertable, the head being withdrawable from the eyelet in a direction perpendicular to the tapes; and a respective brushed fabric strip covering at least one side of each tape and ultrasonically welded to the respective tape along longitudinal weld seams, the respective part or portion of the back strap being inserted between each tape and the respective strip and being affixed thereto.

The method of the invention for making a garment fastener or a brassiere in which such a garment fastener is used can comprise:

(a) injection molding a multiplicity of a male fastener halves onto a first woven synthetic-resin fabric band, the male fastener halves each being formed with a generally flat circular body having an outer body portion on one side of the first band and an inner body portion on another side of the first band, a pin projecting generally centrally from the inner body portion, and a head formed on the pin;

(b) injection molding a multiplicity of female fastener halves onto a second woven synthetic-resin fabric band, each of the female fastener halves being formed with a generally flat circular body having an outer body portion on one side of the second band and an inner body portion on another side of the second band, the inner body portion having an eyelet dimensioned to receive and retain the head and an inlet slot leading to the eyelet through which the pin is laterally insertable;

(c) covering at least one side of each of the bands with a strip of brushed knit fabric and ultrasonically welding the respective strip to the respective band along opposite longitudinal edges thereof to form respective weld seams having gaps therein;

(d) transversely severing the first band at gaps in the weld seams thereof to form first tapes each having at least one of the male fastener halves thereon and transversely severing the second band at gaps in the weld seams thereof to form second tapes each having at least one of the female fastener halves thereon, openings being provided between each tape and the respective strip at an end of the respective tape; and (e) inserting a respective garment portion into each of the openings and securing the respective garment portion to the respective tape and strip.

One of the advantages of the method of the invention is that the free ends of the tape/strip assembly to which the respective portions of the back strap are connected can be separated from the respective hands by cold cutting so that they remain relatively soft. Having not been stiffened by a heated cutting tool there is less likelihood of injury to the wearer from the fastener parts. The halves, when they are joined together by hooking motion, form a relatively thin flat closure without the danger of pressing into the back of the wearer. The thinness of the closure makes it less likely that the back strap of the brassiere will show through the outer garment of the wearer. The parts of the fastener can be connected by the standard hook-and-eye motion to which brassiere wearers are accustomed, although opening of the brassiere can be facilitated because the parts of the closure can be separated by simply pulling the strap parts apart.

BRIEF DESCRIPTION OF THE DRAWING

The above and other objects, features, and advantages will become more readily apparent from the following description, reference being made to the accompanying drawing in which:

FIG. 9 is an elevational view of the fastener;

FIG. 10 is a cross sectional view taken along the line X—X of FIG. 9;

FIG. 11 is a cross sectional view along the line XI—XI of FIG. 9;

SPECIFIC DESCRIPTION

Figure 1:
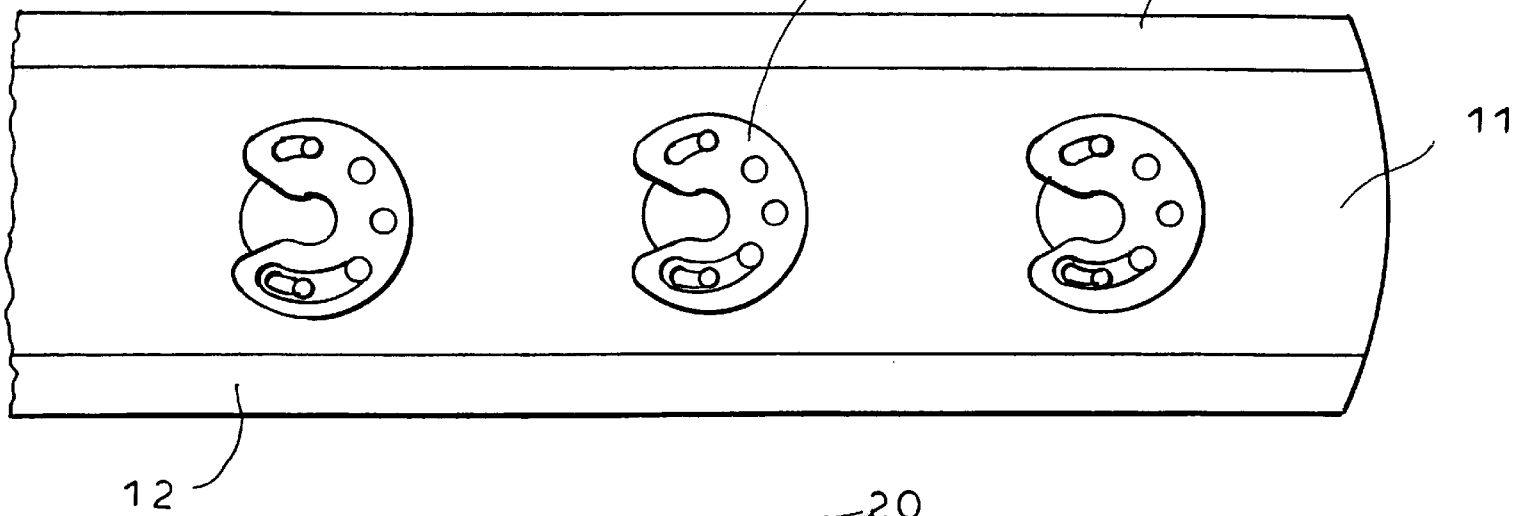
FIG. 1 is a plan view of a first tape covered with a brushed knit fabric strip which can be connected to one part of the back strap of a brassiere showing a plurality of female fastener halves according to the invention.
Figure 2:
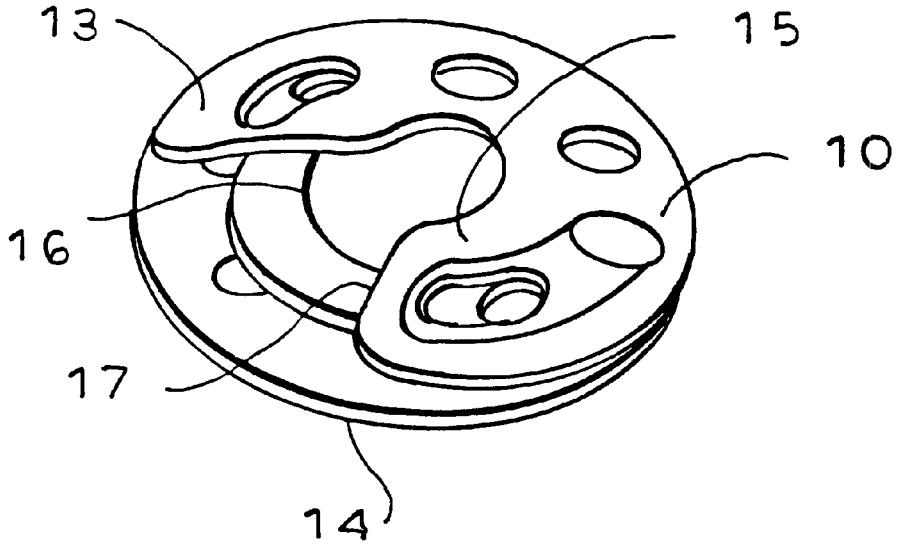
FIG. 2 is a perspective view of one of the female halves from its inner sides.
Figure 3:
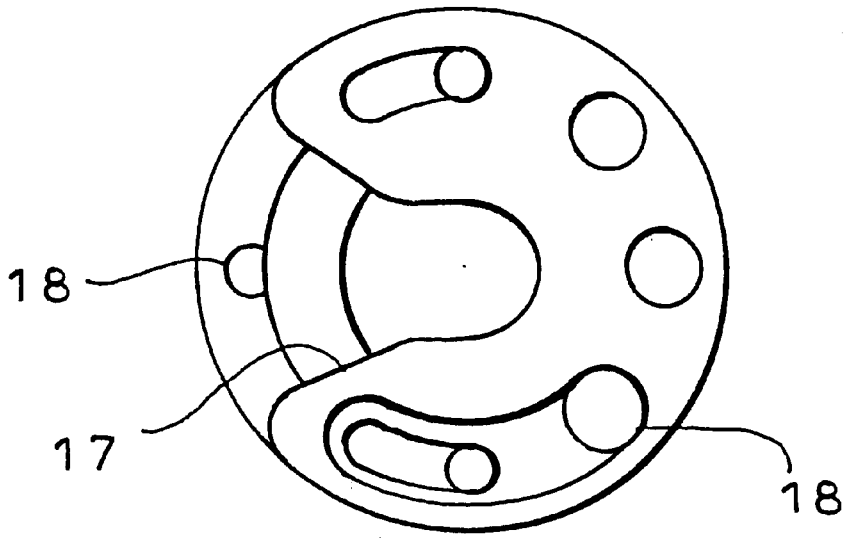
FIG. 3 is a plan view of the female fastener half.
Figure 4:
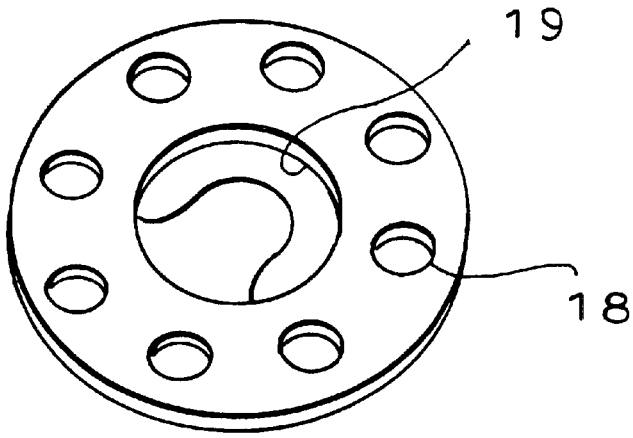
FIG. 4 is a perspective view of the female fastener half from its outer side.

As can be seen from FIG. 1, a plurality of female fastener halves 10 can be injection molded on a woven tape 11 of thermoplastic synthetic resin threads which is covered on one side by a knitted fabric strip as will be described in greater detail with reference to FIGS. 21–24, this strip being folded over onto the inner side of the tape at 12 and welded with a pair of longitudinal weld seams thereto. Each of the female fastener halves 10 (see FIG. 2) has an inner part 13 and an outer part 14 visible on opposite sides of the tape (not seen in FIGS. 2–4), the outer part or body 13 being formed with an eyelet 15 into which a slot 16 opens from the periphery of the inner part, this slot having an inwardly converging mouth 17.

Both the inner and outer parts can have throughgoing holes 18 which facilitate fastening of the injection molded body to the tape.

From the outer side, the eyelet appears as a hole 19 at a center of the injection molded body which may be composed of polyoxymethylene or polyamide.

Figure 5:
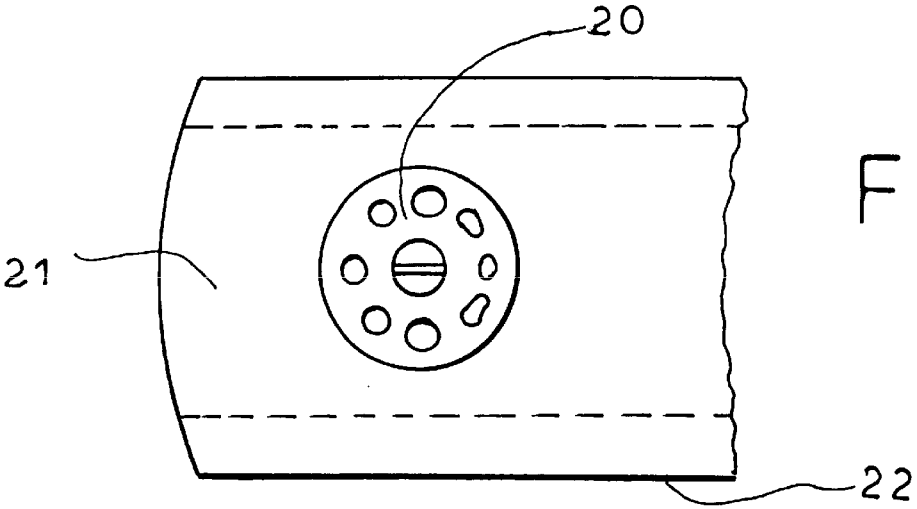
FIG. 5 is a view similar to FIG. 1 showing the tape portion with the male fastener half.
Figure 7:
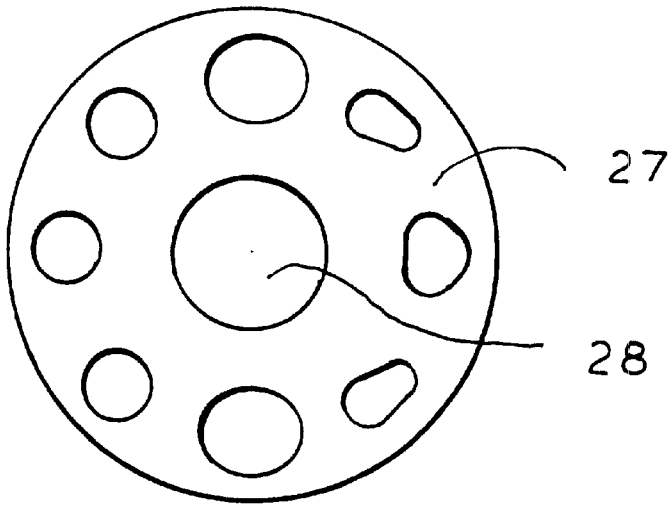
FIG. 7 is a plan view of the outer portion of the male fastener half.
Figure 6:
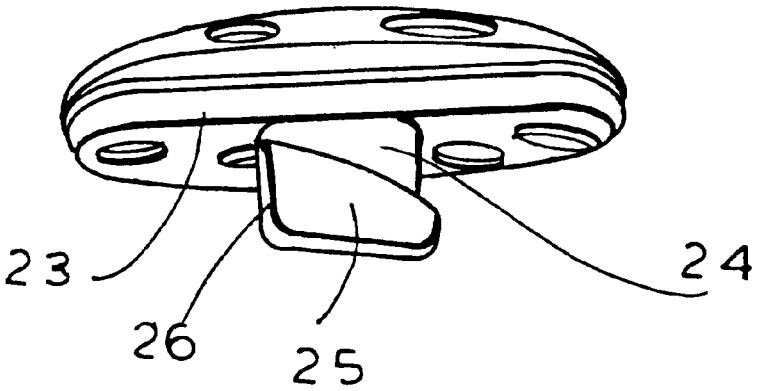
FIG. 6 is a perspective view of the male fastener half.
Figure 8:
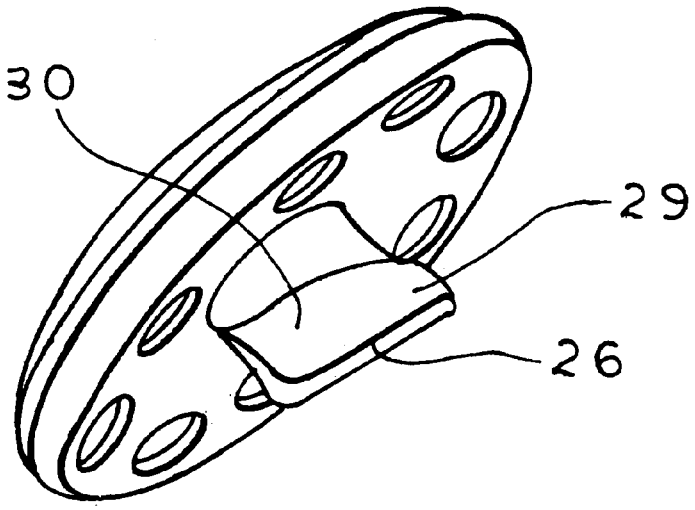
FIG. 8 is a perspective view of the male fastener half as seen from the side of its inner portion.
Figure 16:
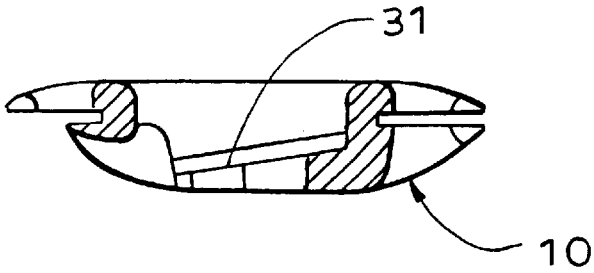
FIG. 16 is a cross sectional view thereof without the engagement of the head of the male half in the eyelet.
Figure 14:
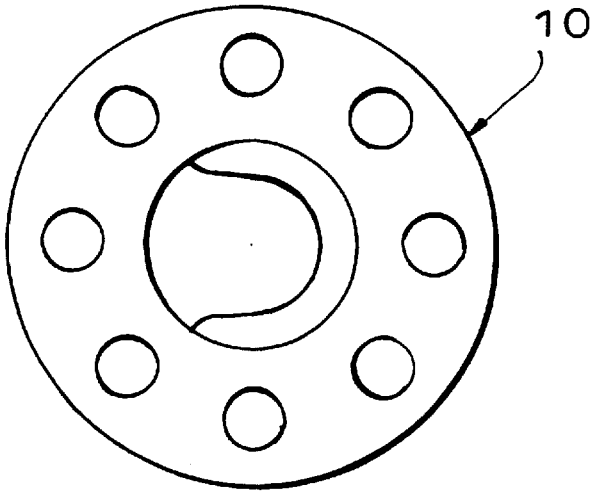
FIG. 14 is a top plan view thereof.
Figure 12:
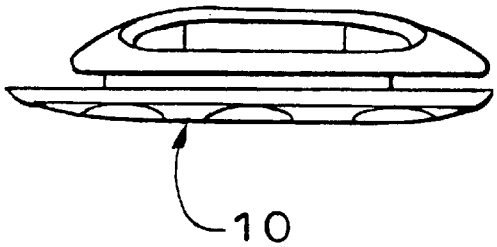
FIG. 12 is a side elevational view of the female fastener half.
Figure 19:
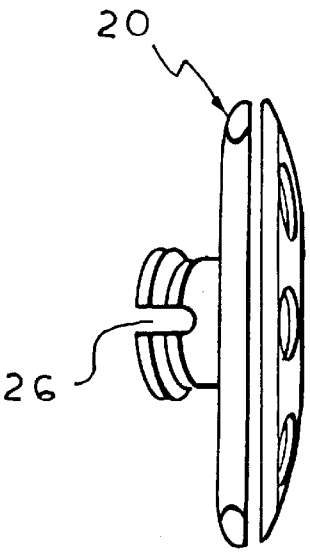
FIG. 19 is a front view of the male fastener half.
Figure 15:
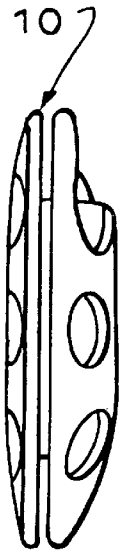
FIG. 15 is a rear view of the female member.

The male fastener half 20 (FIG. 5) may be injection molded on a woven tape 21 which likewise can be covered on its outer side by a strip of knitted fabric, folded over at 22 and ultrasonically welded to the tape. The male fastener half can have an inner body portion 23 formed with a post or pin 24 and a head 25 which is provided with a split 26. The outer body portion is shown at 27 in FIG. 7 and can have a hole 28 at its center aligned with the post. The head 25 tapers from a narrow end 29 to a thick end 30 (FIG. 8) in an insertion direction into the respective eyelet.

From FIG. 10 it will be apparent that the inner body portion 13 of the female fastener half 10, shown in FIG. 10 to be injection molded onto the tape 11, is convex and received in the concave inner body portion 23 of the male fastener half 20 injection molded onto its tape 21.

Figure 13:
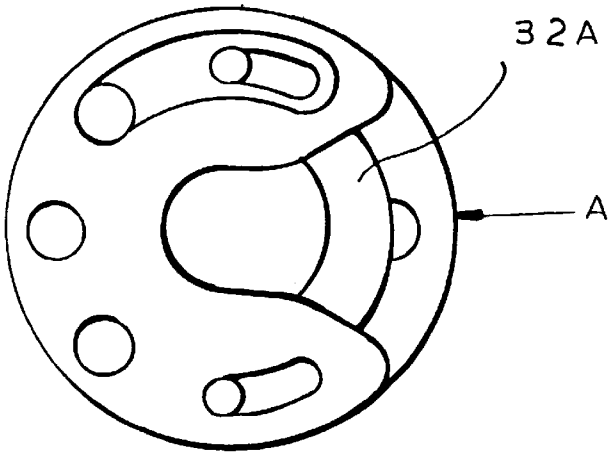
FIG. 13 is a bottom plan view thereof.
Figure 20:
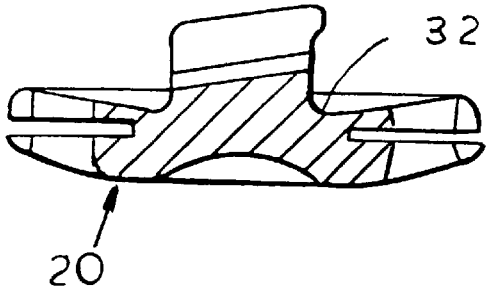
FIG. 20 is a cross section through the male fastener half.
Figure 18:
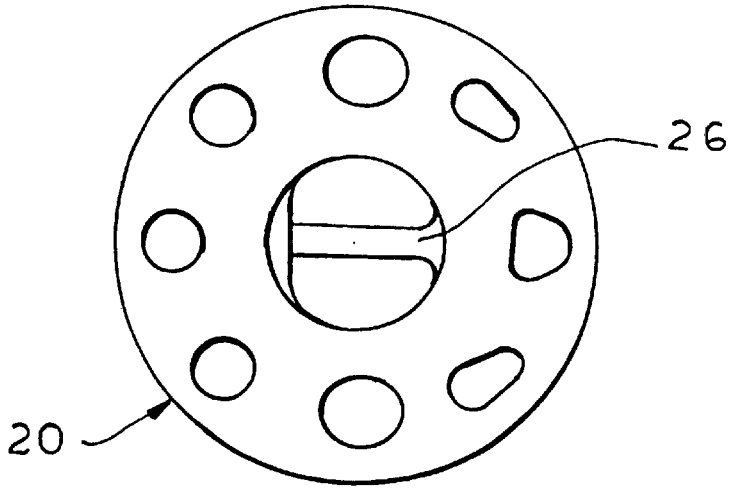
FIG. 18 is a bottom view of the male fastener half.
Figure 17:
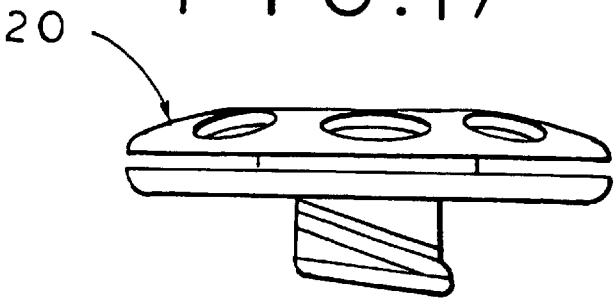
FIG. 17 is a side elevational view of the male fastener half.
Figure 21:
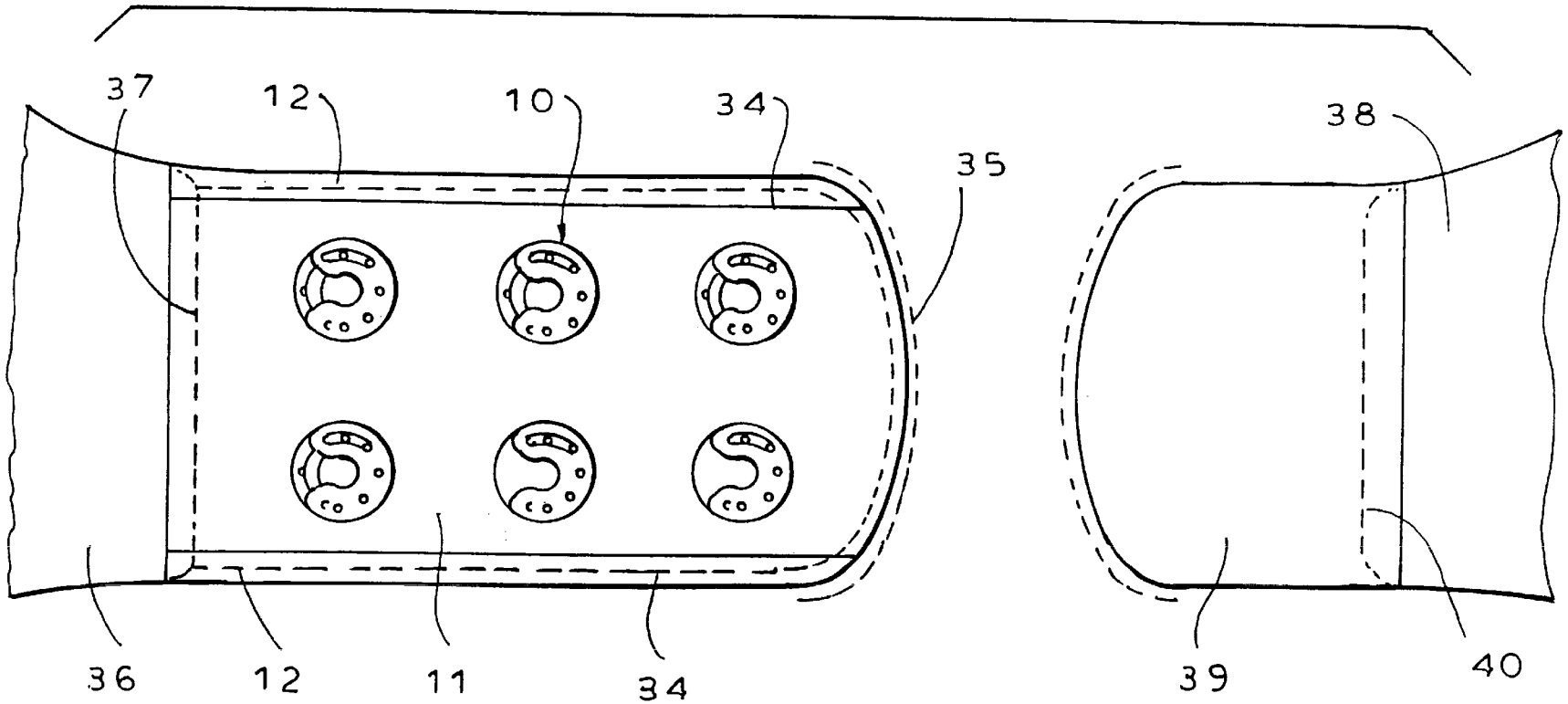
FIG. 21 is an elevational view of the back strap of a brassiere showing the application of the fastener thereto.
Figure 22:
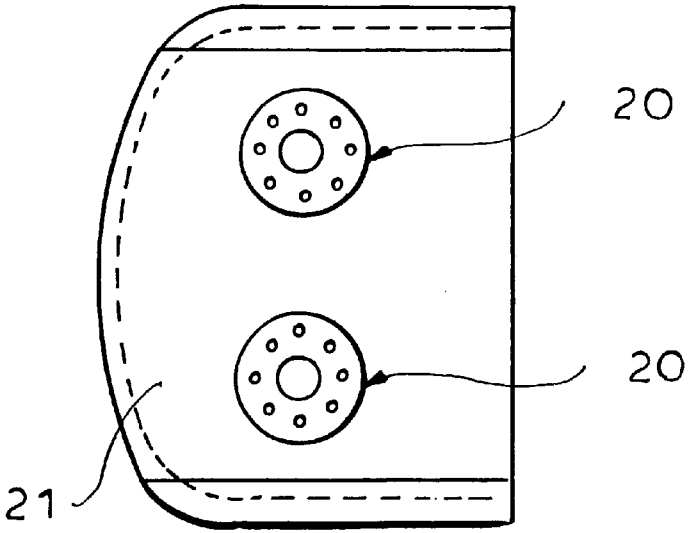
FIG. 22 is a view of one tape of the brassiere.

From FIGS. 10 and 11 it will also be apparent that the thicker portion 30 of the head 25 of the pin 24 lies to the rear of the eyelet and is guided into this position by inclined surfaces 31 of the female fastener half 10 (FIG. 11). The female fastener half is shown in greater detail in FIGS. 12–16 and has a rim 32 surrounding the eyelet and beneath which the thin portion 29 of the head drops when the head is inserted into the eyelet in the direction of A (FIG. 13). Because the head is split and can be squeezed together, the male fastener half can be pulled out of the female fastener half in a direction perpendicular to the tapes.

In FIGS. 17–20, the split 26 of the male fastener half 20 is shown in greater detail. From FIG. 20, moreover, the concavity 32 of the inner body portion of the male fastener head is shown in greater detail.

Figure 23:
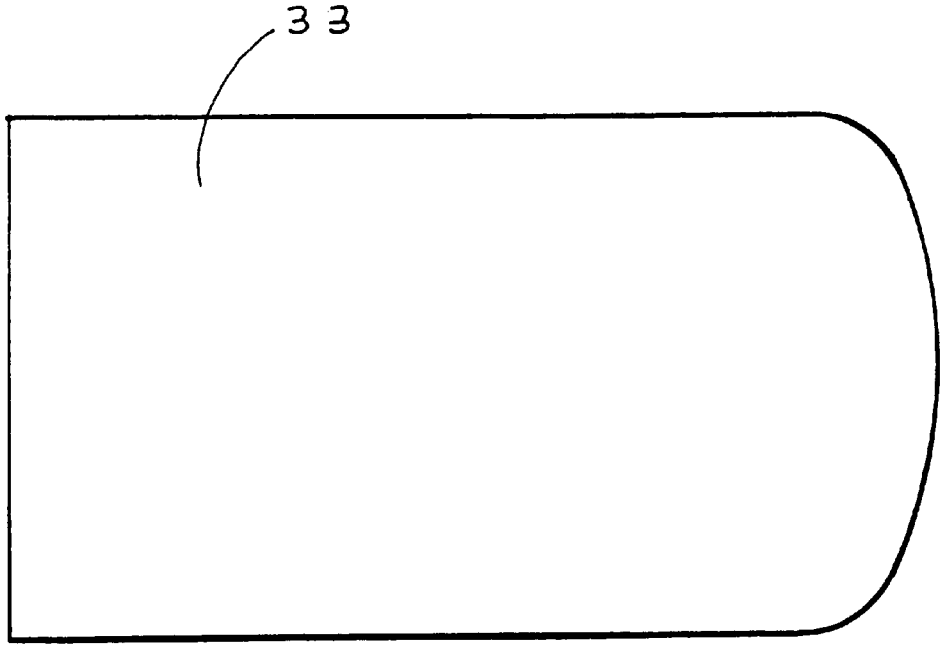
FIG. 23 is a view of the other tape.

As will be apparent form FIGS. 21–24, the female fastener halves 10 may be provided in a succession of rows on the tape 11 which is covered by the brushed tricot strip 33 shown in FIG. 23 so that the folded over edges 12 can be fastened to the tape 11 by ultrasonic weld seams 34 which can have a stitch pattern. The free end of the resulting band can be cold cut at 35 to leave a soft fluffy edge while the opposite end may be open for insertion of the part 36 of the back strap of the brassiere which can then be stitched in place along the seam 37. Similarly, the back strap portion 38 of the brassiere can be inserted between the tape 31 of the male fastener halves 20 and the brushed tricot strip 39 and stitched in place by a stitch seam 40.

Figure 24:
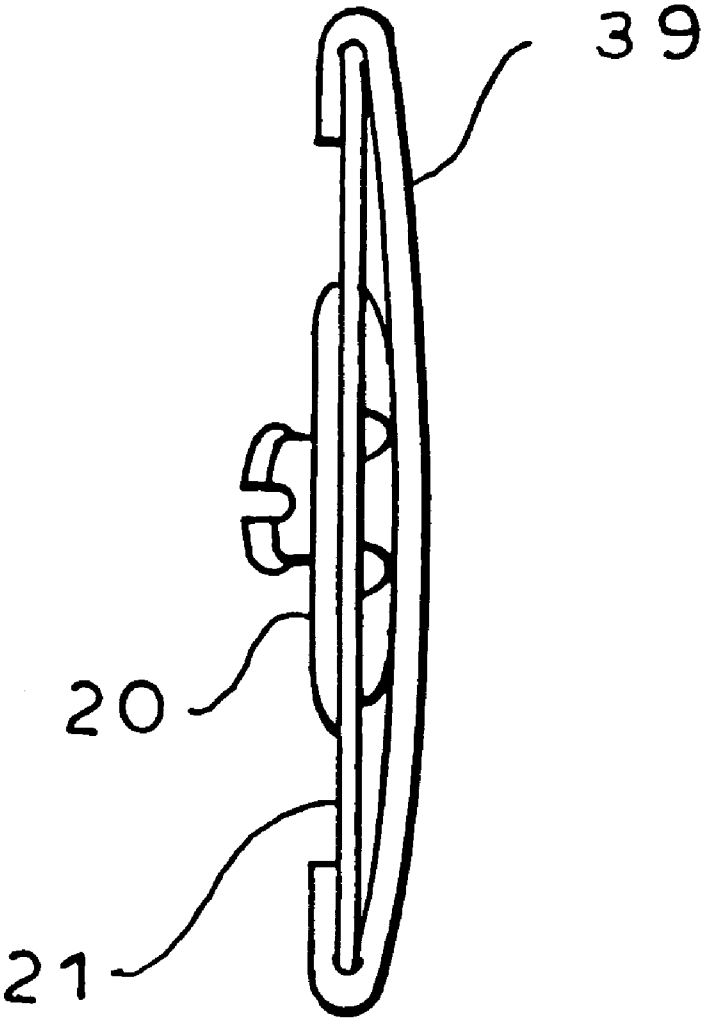
FIG. 24 is a cross section through the tape of the male fastener half.

In FIG. 24 the brushed tricot strip 39 and the woven synthetic resin tape 21 have been shown in greater detail and in section.

We claim:

1. A method of making a garment fastener comprising the steps of:

(a) injection molding a multiplicity of a male fastener halves onto a first woven synthetic-resin fabric band, said male fastener halves each being formed with a generally flat circular body having an outer body portion on one side of the first band and an inner body portion on another side of the first band, a pin projecting generally centrally from said inner body portion, and a head formed on said pin;

(b) injection molding a multiplicity of female fastener halves onto a second woven synthetic-resin fabric band, each of said female fastener halves being formed with a generally flat circular body having an outer body portion on one side of the second band and an inner body portion on another side of the second band, said inner body portion having an eyelet dimensioned to receive and retain said head and an inlet slot leading to said eyelet through which said pin is laterally insertable;

(c) covering at least one side of each of said bands with a strip of brushed knit fabric and ultrasonically welding the respective strip to the respective band along opposite longitudinal edges thereof to form respective weld seams having gaps therein;

(d) transversely severing said first band at gaps in the weld seams thereof to form first tapes each having at least one of said male fastener halves thereon and transversely severing said second band at gaps in the weld seams thereof to form second tapes each having at least one of said female fastener halves thereon, openings being provided between each tape and the respective strip at an end of the respective tape; and (e) inserting a respective garment portion into each of said openings and securing the respective garment portion to the respective tape and strip.

2. The method defined in claim 1 wherein said portions are parts of a back strap of a brassiere and are stitched to the respective tape and strip.

* * * * *